US009863245B2

(12) United States Patent
Freifeld

(10) Patent No.: US 9,863,245 B2
(45) Date of Patent: Jan. 9, 2018

(54) DEVICE USEFUL AS A BOREHOLE FLUID SAMPLER

(71) Applicant: The Regents of the University of California, Oakland, CA (US)

(72) Inventor: Barry M. Freifeld, Oakland, CA (US)

(73) Assignee: The Regents of the University of California, Oakland, CA (US)

( * ) Notice: Subject to any disclaimer, the term of this patent is extended or adjusted under 35 U.S.C. 154(b) by 840 days.

(21) Appl. No.: 14/253,608

(22) Filed: Apr. 15, 2014

(65) Prior Publication Data

US 2014/0305628 A1 Oct. 16, 2014

Related U.S. Application Data

(60) Provisional application No. 61/812,196, filed on Apr. 15, 2013.

(51) Int. Cl.
*E21B 49/08* (2006.01)

(52) U.S. Cl.
CPC ..... *E21B 49/084* (2013.01)

(58) Field of Classification Search
CPC ..... E21B 49/10; E21B 49/08; E21B 49/081; E21B 49/082; E21B 49/084
USPC ..... 166/165
See application file for complete search history.

(56) References Cited

U.S. PATENT DOCUMENTS

| | | | | |
|---|---|---|---|---|
| 4,369,654 | A | 1/1983 | Hallmark | |
| 5,035,149 | A | 6/1991 | Wierenga | |
| 5,692,565 | A | 12/1997 | MacDougall et al. | |
| 6,206,133 | B1 * | 3/2001 | Paulsson | E21B 17/1035 166/206 |
| 7,493,954 | B2 * | 2/2009 | Heller | E21B 43/02 166/250.01 |
| 2002/0166663 | A1 * | 11/2002 | Last | E21B 49/084 166/250.03 |
| 2013/0220594 | A1 | 8/2013 | Freifeld | |

* cited by examiner

*Primary Examiner* — Michael Wills, III

(57) ABSTRACT

The present invention provides a device comprising: (a) a proximal end of the device comprises an inner first conduit within the lumen of an outer second conduit, (b) a distal end of the device comprises the outer second conduit in fluid communication with a third conduit and a fourth conduit through a Y-shaped, T-shaped or U-shaped junction, (c) the third conduit terminates in a triggering mechanism, and (d) the fourth conduit is in fluid communication through a one-way valve, wherein fluid can only convey in a direction from the fourth conduit towards the second outer conduit, with an aperture.

20 Claims, 3 Drawing Sheets

DEVICE USEFUL AS A BOREHOLE FLUID SAMPLER

RELATED PATENT APPLICATIONS

This application claims priority to U.S. Provisional Patent Application Ser. No. 61/812,196, filed Apr. 15, 2013, which is hereby incorporated by reference in its entirety.

STATEMENT OF GOVERNMENTAL SUPPORT

The invention described and claimed herein was made utilizing funds supplied by the U.S. Department of Energy under Contract No. DE-AC02-05CH11231. The government has certain rights in this invention.

FIELD OF THE INVENTION

The present invention is in the field of subsurface fluid sampling.

BACKGROUND OF THE INVENTION

Subsurface wells are typically constructed using steel casings which terminate within or through a reservoir zone of interest, such as where oil and gas is located. Using well-known perforation techniques or by the installation of slotted liners, recoverable resources are able to be produced at the surface through the casing or a secondary string of steel tubulars known as production tubing. It has generally not been of interest to produce fluid samples from above the region of interest.

The U.S. EPA has introduced a new classification of wells, referred to as Class VI injection wells specifically for injecting CO2 into the subsurface. As part of the criteria for installation of a Class VI well, it is required to directly confirm no contamination of the lowermost overlying underground source of drinking water. This would require a fluid sample be taken at this location above the CO2 storage reservoir.

Hydraulic fracturing technology used to recover oil and gas from tight shales can damage cement seals and form leakage pathways along casings. Being able to sample fluids behind casings would enable well operators to identify problematic cement seals and enable mitigation steps to be taken before migration of contaminants into overlying water formations.

PCT International Patent Application No. 2011/035953 discloses a tube-in-tube system comprising: (a) an outer conduit having a proximal end and a distal end, and (b) an inner conduit having a proximal end and a distal end, wherein the inner conduit is disposed within the outer conduit, wherein the proximal end of the inner conduit is in fluid communication with a first aperture, and the proximal end of the outer conduit is in fluid communication with a second aperture, and the distal ends of the inner and outer conduits are in fluid communication with each other and to a third aperture.

Other methods and/or devices have been disclosed by U.S. Pat. Nos. 4,369,654; 5,035,149; and, 5,692,565. Such methods and/or devices have among others, a disadvantage that a new perforation is required for each sample which must then be sealed. In addition, it is required that production through the wellbore be halted while sampling to lower a tool into the well.

SUMMARY OF THE INVENTION

The present invention provides for a device comprising: (a) two tubes attached on the outside of well casing terminating at a U-tube fluid sampling inlet filter and check valve (b) and a means to operate a shape charge device wherein either an electrical or hydraulic signal triggers the shape charge and facilitates connection of the U-tube inlet through perforation tunnels outside of the casing cement sheath into the surrounding formation.

The present invention provides a device comprising: (a) a proximal end of the device comprises an inner first conduit within the lumen of an outer second conduit, (b) a distal end of the device comprises the outer second conduit in fluid communication with a third conduit and a fourth conduit through a Y-shaped, T-shaped or U-shaped junction, (c) the third conduit terminates in a triggering mechanism, and (d) the fourth conduit is in fluid communication through a one-way valve, wherein fluid can only convey in a direction from the fourth conduit towards the second outer conduit, with an aperture.

In some embodiments of the invention, the device is a behind casing fluid sample. In some embodiments, each conduit is a fluid conveyance line. In some embodiments of the invention, the aperture is a check valve, optionally comprising a filter with a plurality of pores, such as, including but not limited to, sintered metal or porous plastic filter. In some embodiments of the invention, the triggering mechanism is in communication, such as with a fuse, with one or more shape charge capable of making a perforation. In some embodiments of the invention, the shape charges are capable of perforating a cement sheath. In some embodiments of the invention, at least a portion of the device is physically connected, such as with one or more clasps, with the outside of a casing of a borehole. In some embodiments of the invention, the device further comprises a pressure transducer, wherein the pressure transducer can provide information on the operation of the device.

In some embodiments, the proximal end of the device is in fluid communication with a tube-in-tube system described by PCT International Patent Application No. 2011/035953, hereby incorporated by reference.

In some embodiments of the invention, the hydraulic signal is transmitted from the surface to the perforation triggering device using the U-tube hydraulic lines. After the triggering device operates it does not interfere with normal operation of the U-tube.

In some embodiments of the invention, a separate electrical line can be used to operate an electrically operated triggering device. The electrical line may be located within the hydraulic lines to minimize the impact on the installation procedure.

In some embodiments of the invention, the electrical line can be used to record data from a permanently deployed pressure/temperature or other sensor after being used to operate the shape charge device.

In some embodiments of the invention, a tube-in-tube device is used to replace two independent hydraulic lines with the advantage being to minimize the impact on cementing operations.

In some embodiments of the invention, an advantage of the behind casing fluid sampler is that it can be installed above the reservoir zone of interest for sampling fluids without having an impact in operations deeper in the borehole. Another advantage of the behind casing fluid sampler is that it can be repeatedly used without requiring any additional devices be installed in the well or that the well be taken off production.

The present invention also provides a robust method of long-term, such as for at least five years, sampling as already has been demonstrated by previous deployments of other U-tube samplers. An example of a long term deployment is the three U-tube samplers that were installed in the Naylor-1 gas well as part of the Otway Project and have been used for five years to collect approximately 250 weekly samples.

In some embodiments of the invention, a well-bore sampler of the present invention is capable of providing minimally contaminated or essentially non-contaminated aliquot or aliquots of multiphase fluids from deep reservoirs and allows for accurate determination of any contaminants that may have migrated along a borehole casing. The well-bore sampler of the present invention can be designed to be permanently mounted on the outside of a casing string and cemented into place.

BRIEF DESCRIPTION OF THE DRAWINGS

The foregoing aspects and others will be readily appreciated by the skilled artisan from the following description of illustrative embodiments when read in conjunction with the accompanying drawings.

DETAILED DESCRIPTION OF THE INVENTION

Figure 1:
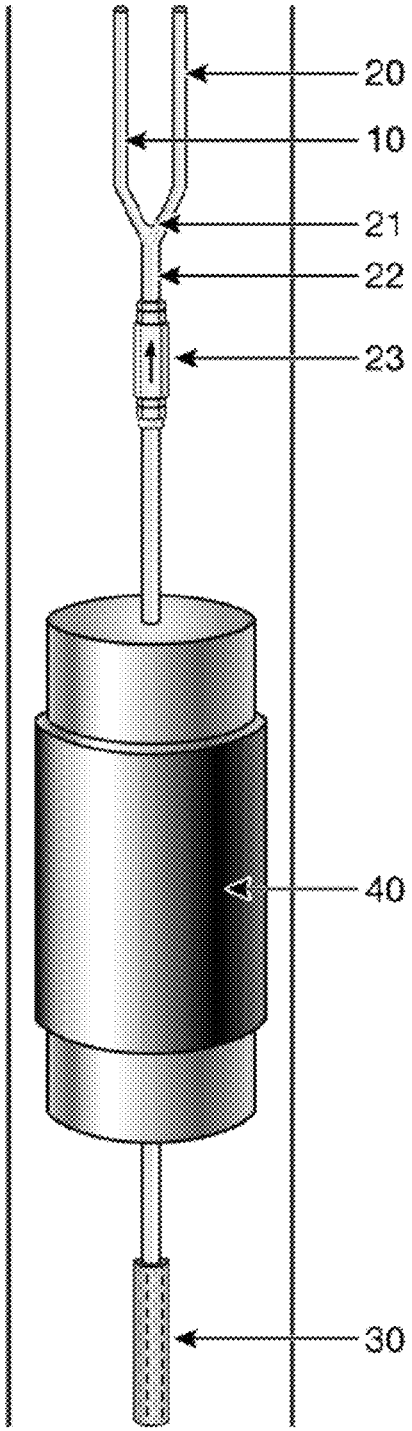
PRIOR ART Figure 1
FIG. 1 shows the prior art U-tube sampling system designed for sampling inside a borehole.

Before the present invention is described, it is to be understood that this invention is not limited to particular embodiments described, as such may, of course, vary. It is also to be understood that the terminology used herein is for the purpose of describing particular embodiments only, and is not intended to be limiting, since the scope of the present invention will be limited only by the appended claims.

Where a range of values is provided, it is understood that each intervening value, to the tenth of the unit of the lower limit unless the context clearly dictates otherwise, between the upper and lower limits of that range is also specifically disclosed. Each smaller range between any stated value or intervening value in a stated range and any other stated or intervening value in that stated range is encompassed within the invention. The upper and lower limits of these smaller ranges may independently be included or excluded in the range, and each range where either, neither or both limits are included in the smaller ranges is also encompassed within the invention, subject to any specifically excluded limit in the stated range. Where the stated range includes one or both of the limits, ranges excluding either or both of those included limits are also included in the invention.

Unless defined otherwise, all technical and scientific terms used herein have the same meaning as commonly understood by one of ordinary skill in the art to which this invention belongs. Although any methods and materials similar or equivalent to those described herein can be used in the practice or testing of the present invention, the preferred methods and materials are now described. All publications mentioned herein are incorporated herein by reference to disclose and describe the methods and/or materials in connection with which the publications are cited.

As used in the specification and the appended claims, the singular forms "a", "an", and "the" include plural references unless the context clearly dictates otherwise. Thus, for example, reference to a "support" includes a single support as well as a plurality of supports.

The terms "optional" or "optionally" as used herein mean that the subsequently described feature or structure may or may not be present, or that the subsequently described event or circumstance may or may not occur, and that the description includes instances where a particular feature or structure is present and instances where the feature or structure is absent, or instances where the event or circumstance occurs and instances where it does not.

These and other objects, advantages, and features of the invention will become apparent to those persons skilled in the art upon reading the details of the invention as more fully described below.

In some embodiments of the invention, the outer conduit has an outer diameter that ranges from 0.2 inch to 1.0 inch. In some embodiments of the invention, the outer conduit has an outer diameter that ranges from 0.3 inch to 0.6 inch. In some embodiments of the invention, the outer conduit has an outer diameter that ranges from 0.35 inch to 0.4 inch. In some embodiments of the invention, the outer conduit has an outer diameter of about 0.375 inch. In some embodiments of the invention, the outer conduit has a wall thickness that ranges from 0.02 inch to 0.1 inch. In some embodiments of the invention, the outer conduit has a wall thickness that ranges from 0.04 inch to 0.06 inch. In some embodiments of the invention, the outer conduit has a wall thickness that ranges from about 0.035 inch to 0.049 inch. In some embodiments of the invention, the outer conduit has a wall thickness of about 0.049. In some embodiments of the invention, the outer conduit has an outer diameter of about 0.375 inch, and a wall thickness of about 0.049.

In some embodiments of the invention, the inner conduit has an outer diameter that ranges from 0.1 inch to 0.5 inch. In some embodiments of the invention, the inner conduit has an outer diameter that ranges from 0.2 inch to 0.3 inch. In some embodiments of the invention, the inner conduit has an outer diameter of about 0.25 inch. In some embodiments of the invention, the inner conduit has a wall thickness that ranges from 0.02 inch to 0.07 inch. In some embodiments of the invention, the inner conduit has a wall thickness that ranges from 0.03 inch to 0.04 inch. In some embodiments of the invention, the inner conduit has a wall thickness that ranges from about 0.035 inch to 0.049 inch. In some embodiments of the invention, the inner conduit has a wall thickness of about 0.035. In some embodiments of the invention, the inner conduit has an outer diameter of about 0.25 inch, and a wall thickness of about 0.035.

The inner diameter of the outer conduit is always greater than the outer diameter of the inner conduit. In some embodiments of the invention, the outer conduit has an outer diameter of about 0.375 inch, and a wall thickness of about 0.049, and the inner conduit has an outer diameter of about 0.25 inch, and a wall thickness of about 0.035.

The behind casing fluid sampling system of the present invention is useful for the collecting of formation fluid samples, especially high frequency recovery of representative and uncontaminated aliquots of a rapidly changing two-phase fluid (such as natural gas-brine) fluid. Samples can be collected from depths up to 5 km depth. Such samples can provide insights into the presence or absence of migrated fluids along the length of a borehole.

The behind casing fluid sampling system is particularly suited for long-term monitoring to ensure that wellbore cement is not functioning properly and that a hydraulic fracturing operation has not led to containment failure of the deeper oil or gas reservoir zones.

In some embodiments of the invention an insulated electrical line encapsulated in stainless steel can be collocated with the U-tube fluid sampling tubes and used to trigger a perforation for connecting the fluid sampler to the formation. That same electrical line can also be used to transmit signals from a downhole sensor to the surface.

FIG. 1 shows a prior art U-tube sampling system designed for collecting fluids within a borehole. It is seen that U-tube drive line 10 is used as a conduit by which compressed gas from the surface is used to recover a sample up sample line 20. Drive line 10 and sample line 20 are connected at a "tee" 21 which connects a tube 22 that passes through a packer to a one way check valve 23. The inlet for fluid to check valve 23 is a filter with small pores 30 such as sintered metal or porous plastic that protects check valve 23 from contamination. Packer 40 is used to isolate the wellbore section of interest so that the fluid beneath the packer is representative of where the casing is open to the surrounding formation.

Figure 2:
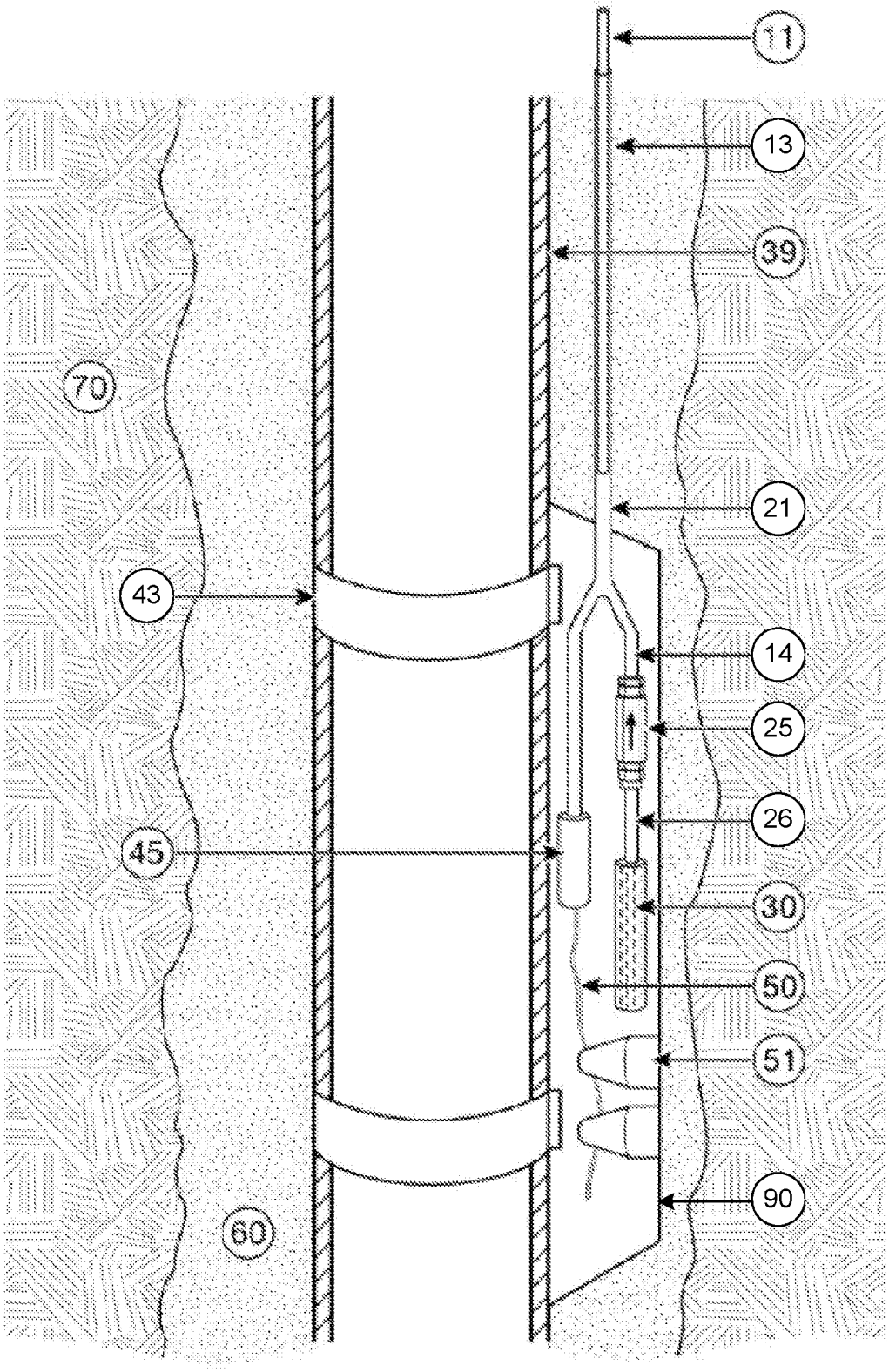
FIG. 2 shows a tube-in-tube U-tube sampling system configured for permanent mounting on a borehole casing.

FIG. 2 shows the external casing fluid sampling system. A tube-in-tube control line with exterior line 13 and interior line 11 terminates at a "tee" 21 which connects the interior and exterior tube-in-tube lines. Fluid conveyance line 14 connects "tee" 21 to one-way check valve 25, which is connected by line 26 to inlet filter 30. When the external casing fluid sampling system is deployed it is connected to the outside of the casing 39 by clamps 43 connected to a chamber 90 containing the external casing fluid sampling system. Filling tube-in-tube lines 13 and 11 with fluid along with a surcharge of pressure is used to close check valve 25 and admit a pressure signal to triggering mechanism 45. By a means well-known to one of ordinary skill in the art a hydraulic signal can be used to send a detonation signal through fuse 50 to activate shape charge perforators 51. Shape charge perforators 51 penetrate the cement sheath 60 surrounding the casing 39 connecting the U-tube inlet 30 to the formation 70.

The behind casing fluid sampler can function identically with two separate tubes as with a single tube-in-tube, but the tube-in-tube is considered advantageous as it is simpler to install and less likely to create bridging during cementing operations.

Figure 3:
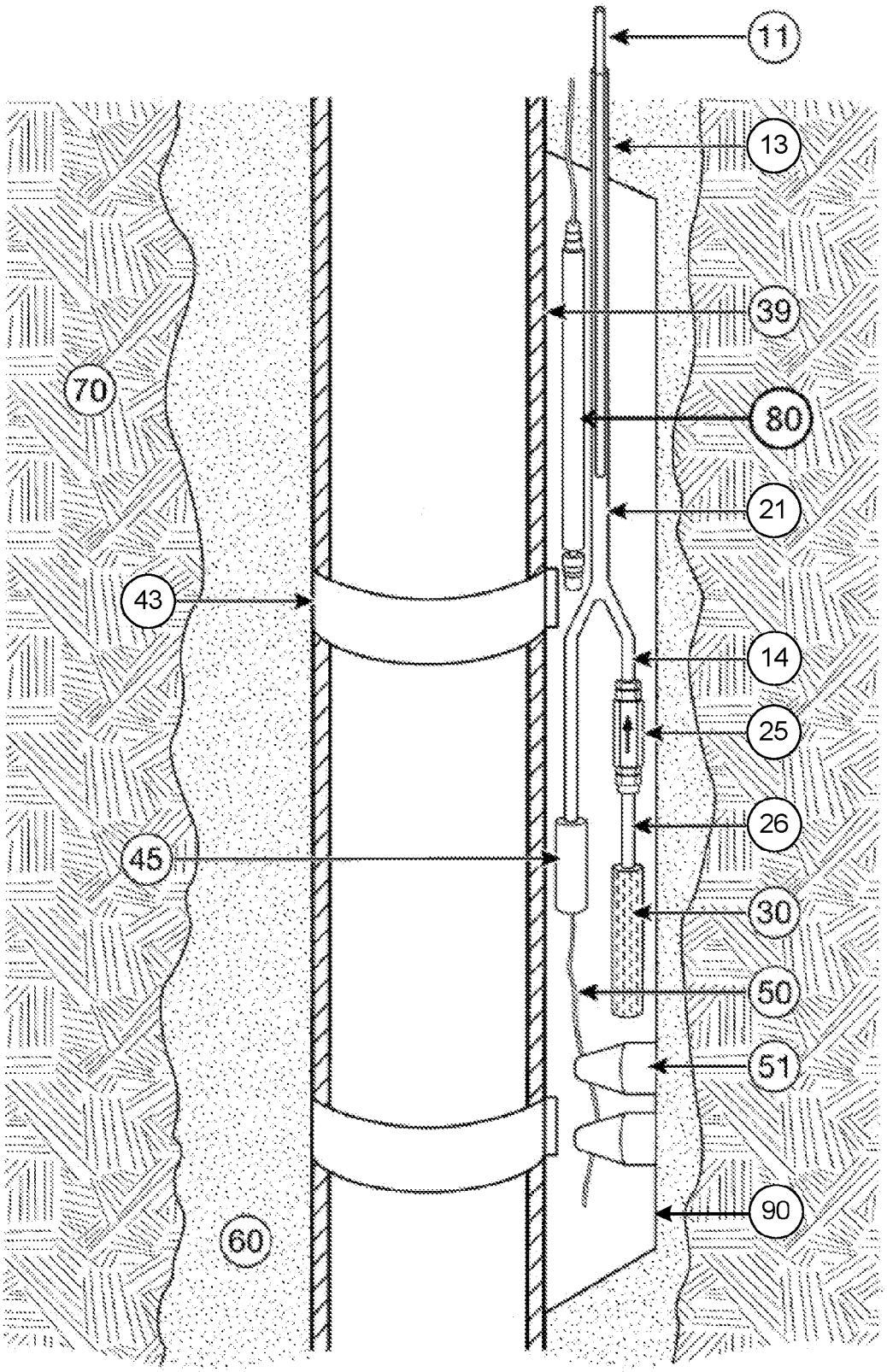
FIG. 3 shows a behind casing fluid sampler with a permanently deployed pressure/temperature sensor.

FIG. 3 Show a modified behind casing fluid sampler which has incorporated a pressure transducer 80. Pressure transducer 80 can be used to provide information on the operation of the behind casing sampling system, in particular identifying hydrologic properties of the surrounding formation 70 when fluid is drawn up into the sampler.

It is to be understood that, while the invention has been described in conjunction with the preferred specific embodiments thereof, the foregoing description is intended to illustrate and not limit the scope of the invention. Other aspects, advantages, and modifications within the scope of the invention will be apparent to those skilled in the art to which the invention pertains.

All patents, patent applications, and publications mentioned herein are hereby incorporated by reference in their entireties.

It is to be understood that, while the invention has been described in conjunction with the preferred specific embodiments thereof, the foregoing description is intended to illustrate and not limit the scope of the invention. Other aspects, advantages, and modifications within the scope of the invention will be apparent to those skilled in the art to which the invention pertains.

All patents, patent applications, and publications mentioned herein are hereby incorporated by reference in their entireties.

The examples of the invention described herein are offered to illustrate the subject invention by way of illustration, not by way of limitation.

While the present invention has been described with reference to the specific embodiments thereof, it should be understood by those skilled in the art that various changes may be made and equivalents may be substituted without departing from the true spirit and scope of the invention. In addition, many modifications may be made to adapt a particular situation, material, composition of matter, process, process step or steps, to the objective, spirit and scope of the present invention. All such modifications are intended to be within the scope of the claims appended hereto.

I claim:

1. A device comprising:

a first conduit, an end of the first conduit in fluid communication with a second conduit and a third conduit;

a triggering mechanism, an end of the second conduit being attached to the triggering mechanism and operable to convey a signal to the triggering mechanism, the triggering mechanism in communication with one or more shape charges operable to form a perforation in a material surrounding a borehole casing; and a one-way valve, the third conduit in fluid communication with the one-way valve, the one-way valve operable to allow fluid to pass in a direction towards the first conduit.

2. The device of claim 1, wherein the first conduit, the second conduit, and the third conduit are each a fluid conveyance line.

3. The device of claim 1, wherein the material comprises a cement sheath.

4. The device of claim 1, further comprising:

a plurality of clamps, wherein the plurality of clamps is operable to connect a chamber containing the device to the outside of the borehole casing.

5. The device of claim 1, further comprising:

a pressure transducer, wherein the pressure transducer is operable to provide information on operation of the device.

6. The device of claim 1, further comprising:

a fourth conduit in fluid communication with the one-way valve; and a filter including a plurality of pores, wherein the filter is in communication with the fourth conduit.

7. The device of claim 6, wherein the filter is selected from a group consisting of a sintered metal filter and a porous plastic filter.

8. The device of claim 1, wherein the second conduit and the third conduit are in fluid communication with the first conduit through a Y-shaped junction.

9. The device of claim 1, wherein the signal comprises a pressure signal.

10. The device of claim 1, wherein the first conduit has an inner diameter that is smaller than an outer diameter of an inner conduit, and wherein the inner conduit is operable to be inserted into the first conduit.

11. A device comprising:

a first conduit, an end of the first conduit in fluid communication with a second conduit and a third conduit;

a triggering mechanism, an end of the second conduit being attached to the triggering mechanism and operable to convey a signal to the triggering mechanism;

a one-way valve, the third conduit in fluid communication with the one-way valve, the one-way valve operable to allow fluid to pass in a direction towards the first conduit; and a plurality of clamps, the plurality of clamps being operable to connect a chamber containing the device to the outside of a borehole casing.

12. The device of claim 11, wherein the first conduit, the second conduit, and the third conduit are each a fluid conveyance line.

13. The device of claim 11, further comprising:

a fourth conduit in fluid communication with the one-way valve; and a filter including a plurality of pores, wherein the filter is in communication with the fourth conduit.

14. The device of claim 13, wherein the filter is selected from a group consisting of a sintered metal filter and a porous plastic filter.

15. The device of claim 11, wherein the triggering mechanism is in communication with one or more shape charges operable to form a perforation in a material surrounding a borehole casing.

16. The device of claim 15, wherein the material comprises a cement sheath.

17. The device of claim 11, further comprising:

a pressure transducer, wherein the pressure transducer is operable to provide information on operation of the device.

18. The device of claim 11, wherein the second conduit and the third conduit are in fluid communication with the first conduit through a Y-shaped junction.

19. The device of claim 11, wherein the signal comprises a pressure signal.

20. The device of claim 11, wherein the first conduit has an inner diameter that is smaller than an outer diameter of an inner conduit, and wherein the inner conduit is operable to be inserted into the first conduit.

* * * * *